US010046213B2

(12) United States Patent
Goldfader

(10) Patent No.: US 10,046,213 B2
(45) **Date of Patent: *Aug. 14, 2018**

(54) GOLF PUTTER GRIP HAVING FLAT SURFACE AREAS

(71) Applicant: Louis Goldfader, Richardson, TX (US)

(72) Inventor: Louis Goldfader, Richardson, TX (US)

( * ) Notice: Subject to any disclaimer, the term of this patent is extended or adjusted under 35 U.S.C. 154(b) by 30 days.

This patent is subject to a terminal disclaimer.

(21) Appl. No.: 15/646,358

(22) Filed: Jul. 11, 2017

(65) Prior Publication Data

US 2017/0304694 A1 Oct. 26, 2017

Related U.S. Application Data

(63) Continuation of application No. 14/716,703, filed on May 19, 2015, now Pat. No. 9,700,772.

(51) Int. Cl.

| | |
|---|---|
| ***A63B 53/14*** | (2015.01) |
| ***A63B 53/00*** | (2015.01) |
| *A63B 69/36* | (2006.01) |
| *A63B 60/12* | (2015.01) |

(52) U.S. Cl.

CPC ..... *A63B 53/14* (2013.01); *A63B 53/007* (2013.01); *A63B 60/12* (2015.10); *A63B 69/3676* (2013.01)

(58) Field of Classification Search

USPC ..... 473/201, 203, 204, 215, 297, 300, 303, 473/340, 409

See application file for complete search history.

(56) References Cited

U.S. PATENT DOCUMENTS

| | | | | |
|---|---|---|---|---|
| 3,837,647 | A | 9/1974 | Jacques | |
| 4,537,403 | A | 8/1985 | Farina | |
| D355,011 | S | 1/1995 | Subnick | |
| 5,575,724 | A | 11/1996 | Hannon et al. | |
| 5,779,559 | A | 7/1998 | Eberle | |
| 5,993,327 | A | 11/1999 | Terril | |
| 6,786,835 | B1 * | 9/2004 | Carter | A63B 53/007 473/300 |
| 6,902,492 | B1 | 6/2005 | Strand | |
| D602,546 | S | 10/2009 | Lin | |
| 9,700,772 | B2 * | 7/2017 | Goldfader | A63B 53/14 |
| 2003/0162599 | A1 * | 8/2003 | Klein | A63B 53/007 473/251 |

* cited by examiner

*Primary Examiner* — Nini Legesse

(74) *Attorney, Agent, or Firm* — Gregory M. Howison

(57) ABSTRACT

A golf club grip for attachment to a shaft of a golf club, the grip comprising an elongated body including a proximate end, a distal end, a first flat surface, the first flat surface having a proximate edge, a distal edge, a first long edge, and a second long edge, a second flat surface, the second flat surface having a proximate edge, a distal edge, a first long edge, and a second long edge, a first curved surface having an outwardly convex curvature, the first curved surface having a curved edge between the first long edge of the first flat surface and the first long edge of the second flat surface, and a second curved surface having an outwardly convex curvature, the second curved surface having a curved edge between the second long edge of the first flat surface and the second long edge of the second flat surface.

20 Claims, 18 Drawing Sheets

GOLF PUTTER GRIP HAVING FLAT SURFACE AREAS

CROSS-REFERENCE TO RELATED APPLICATIONS

This application is a continuation of U.S. patent application Ser. No. 14/716,703, filed May 19, 2015, entitled GOLF PUTTER GRIP HAVING FLAT SURFACE AREAS, now U.S. Pat. No. 9,700,772, issued on Jul. 11, 2017, the specification of which is incorporated by reference herein in its entirety.

TECHNICAL FIELD

The following disclosure relates to golf clubs and, more specifically, grips for golf clubs.

BACKGROUND

Golf club and golf putter grips of various shapes, sizes, and other configurations are known. Golf club and golf putter grip designs constantly evolve in order to attempt to reach the optimum grip and, consequently, the best performance possible. Many grips are not designed in a way that provides optimum grip and, instead, are awkward to hold or allow too much movement within the hand. Thus, there is a need for grips that provide for a tighter grip, while also being more comfortable, than grips already known.

SUMMARY

In one aspect thereof, a golf club grip is provided for attachment to a shaft of a golf club. The grip comprises an elongated body defining a longitudinal axis running therethrough, the elongated body including a proximate end, a distal end, a first flat surface defining a first plane and spaced apart from the longitudinal axis, the first flat surface having a proximate edge, a distal edge spaced longitudinally apart from the proximate edge, a first long edge extending between the proximate edge and the distal edge, and a second long edge spaced apart from the first long edge and extending between the proximate edge and the distal edge, the first and second long edges further defining a first center line disposed on the first plane midway therebetween, and whereby when the first center line is viewed in a direction perpendicular to the longitudinal axis, the first center line appears parallel to the longitudinal axis, a second flat surface defining a second plane and spaced apart from both the longitudinal axis and the first flat surface, the second flat surface having a proximate edge, a distal edge spaced longitudinally apart from the proximate edge, a first long edge extending between the proximate edge and the distal edge, and a second long edge spaced apart from the first long edge and extending between the proximate edge and the distal edge, the first and second long edges further defining a second center line disposed on the second plane midway therebetween, and whereby when the first center line is viewed in a direction perpendicular to the longitudinal axis, the first center line appears parallel to the longitudinal axis. The grip further comprises a first curved surface having an outwardly convex curvature relative to the longitudinal axis, the first curved surface having a curved edge connected between a first intermediate curved surface and a second intermediate curved surface, wherein the first intermediate curved surface is connected between the first long edge of the first flat surface and the first curved surface and the second intermediate curved surface is connected between the first long edge of the second flat surface and the first curved surface and a second curved surface having an outwardly convex curvature relative to the longitudinal axis, the second curved surface having a curved edge connected between a third intermediate curved surface and a fourth intermediate curved surface, wherein the third intermediate curved surface is connected between the second long edge of the first flat surface and the second curved surface and the fourth intermediate curved surface is connected between the second long edge of the second flat surface and the second curved surface.

In another embodiment, the first flat surface and the second flat surface are positioned on opposing sides of the elongated body.

In another embodiment, the first flat surface and the second flat surface are parallel.

In another embodiment, the radius of curvature of the first curved surface and the radius of curvature of the second curved surface are equal.

In another embodiment, the cross-section of the elongated body is constant.

In another embodiment, the first curved surface and the second curved surface have a radius of curvature between 0.25 inches and 8 inches.

In another embodiment, a width of the second flat surface is narrower than the width of the first flat surface.

In another embodiment, a ratio of a width of the proximate end, measured from the center of the curved edge of the first curved surface to the center of the curved edge of the second curved surface, to a height of the proximate end, measured from the proximate edge of the first flat surface to the proximate edge of the second flat surface, is within a range that is greater than or equal to 0.5 and less than 1.

In another embodiment, the elongated body further includes a first tapered surface having a first straight edge corresponding to the distal edge of the first flat surface, the first tapered surface narrowing in width and ending in a first arcuate edge opposite the first straight edge, a second tapered surface having a second straight edge corresponding to the distal edge of the second flat surface, the second tapered surface narrowing in width and ending in a second arcuate edge opposite the second straight edge, a third tapered surface having a first curved edge disposed and connected between the first straight edge of the first tapered surface and the second straight edge of the second tapered surface, the third tapered surface narrowing in width and ending in a third arcuate edge opposite the first curved edge, and a fourth tapered surface having a second curved edge disposed and connected between the first straight edge of the first tapered surface and the second straight edge of the second tapered surface, the fourth tapered surface narrowing in width and ending in a fourth arcuate edge opposite the second curved edge.

In another embodiment, the first, second, third, and fourth arcuate edges intersect to form an arcuate end at the distal end of the golf club grip.

In another embodiment, a ratio of a width of the proximate end, measured from the center of the curved edge of the first curved surface to the center of the curved edge of the second curved surface, to a height of the proximate end, measured from the proximate edge of the first flat surface to the proximate edge of the second flat surface, is within a range that is greater than or equal to 0.5 and less than 1.

In another aspect thereof, a golf putter is provided. The putter comprises a shaft, a head fixedly connected to a lower end of the shaft, a grip fixedly connected to an upper end of the shaft, the grip including an elongated body defining a longitudinal axis running therethrough, the elongated body including a proximate end a distal end, a first flat surface defining a first plane and spaced apart from the longitudinal axis, the first flat surface having a proximate edge, a distal edge spaced longitudinally apart from the proximate edge, a first long edge extending between the proximate edge and the distal edge, and a second long edge spaced apart from the first long edge and extending between the proximate edge and the distal edge, the first and second long edges further defining a first center line disposed on the first plane midway therebetween, and whereby when the first center line is viewed in a direction perpendicular to the longitudinal axis, the first center line appears parallel to the longitudinal axis, a second flat surface defining a second plane and spaced apart from both the longitudinal axis and the first flat surface, the second flat surface having a proximate edge, a distal edge spaced longitudinally apart from the proximate edge, a first long edge extending between the proximate edge and the distal edge, and a second long edge spaced apart from the first long edge and extending between the proximate edge and the distal edge, the first and second long edges further defining a second center line disposed on the second plane midway therebetween, and whereby when the first center line is viewed in a direction perpendicular to the longitudinal axis, the first center line appears parallel to the longitudinal axis, a first curved surface having an outwardly convex curvature relative to the longitudinal axis, the first curved surface having a curved edge connected between a first intermediate curved surface and a second intermediate curved surface, wherein the first intermediate curved surface is connected between the first long edge of the first flat surface and the first curved surface and the second intermediate curved surface is connected between the first long edge of the second flat surface and the first curved surface, and a second curved surface having an outwardly convex curvature relative to the longitudinal axis, the second curved surface having a curved edge connected between a third intermediate curved surface and a fourth intermediate curved surface, wherein the third intermediate curved surface is connected between the second long edge of the first flat surface and the second curved surface and the fourth intermediate curved surface is connected between the second long edge of the second flat surface and the second curved surface.

BRIEF DESCRIPTION OF THE DRAWINGS

For a more complete understanding, reference is now made to the following description taken in conjunction with the accompanying Drawings in which.

DETAILED DESCRIPTION

Figure 1A:
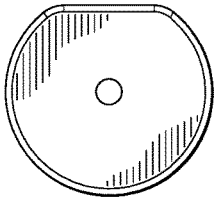
FIG. 1A (PRIOR ART)
FIG. 1A illustrates a view of a proximate end of a golf grip known to be prior art.
Figure 1B:
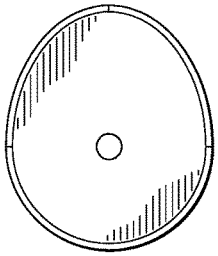
FIG. 1B (PRIOR ART)
FIG. 1B illustrates a view of a proximate end of another golf grip known to be prior art.
Figure 1C:
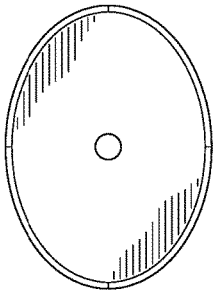
FIG. 1C (PRIOR ART)
FIG. 1C illustrates a view of a proximate end of another golf grip known to be prior art.
Figure 1D:
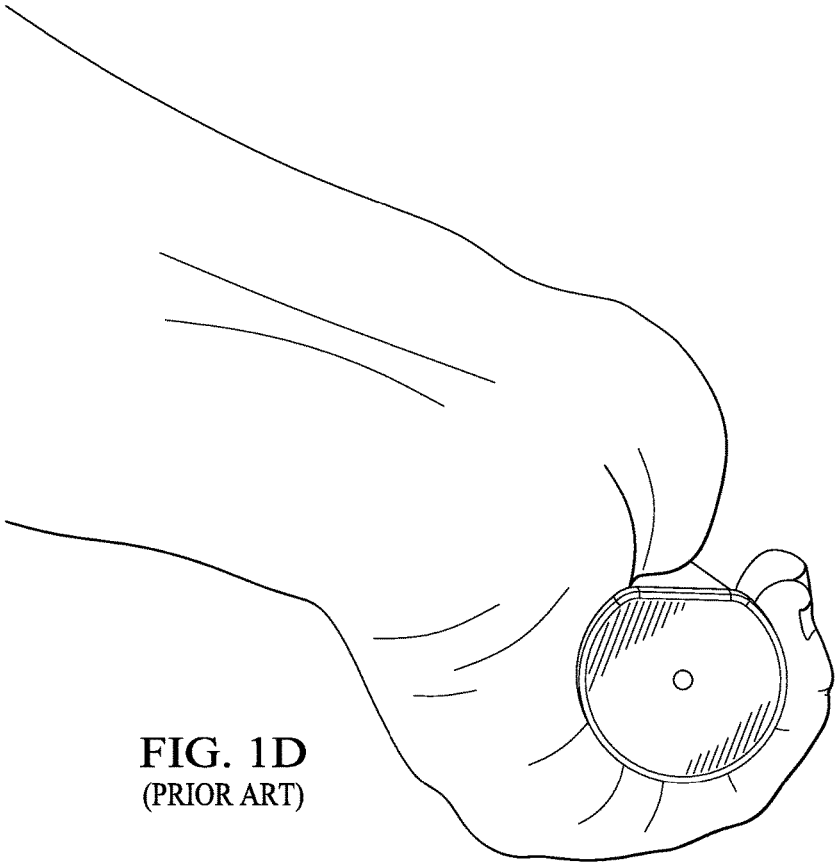
FIG. 1D (PRIOR ART)
FIG. 1D illustrates a view of the proximate end of the golf club grip of FIG. 1A held in a user's hand.

Referring now to the drawings, wherein like reference numbers are used herein to designate like elements throughout, the various views and embodiments of a golf putter grip having flat surface areas are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring now to FIGS. 1A-1D, there is illustrated golf grips known to be prior art.

Figure 2A:
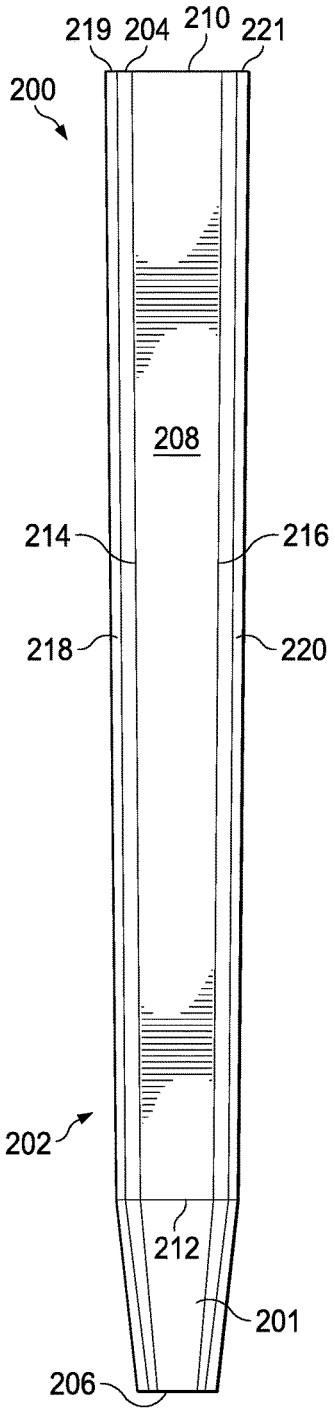
FIG. 2A illustrates a top view of one embodiment of a golf putter grip.

Referring now to FIG. 2A, there is illustrated a top view of one embodiment of a golf putter grip 200. The golf putter grip 200 has an elongated body 202. The elongated body has a proximate end 204 and a tapered nose 201 ending at a distal end 206. The elongated body 202 may define a longitudinal axis traveling through the center of the elongated body 202 from the proximate end 204 through the distal end 206. The elongated body also has a first flat surfaced 208, which is typically oriented as the top of the elongated body 202. The first flat surface 208 may define a center line disposed in the center of the first flat surface 208 and running longitudinally across the first flat surface 208. The first flat surface 208 includes a proximate edge 210 located at the proximate end 204 of the elongated body 202, and a distal edge 212 located near the distal end 206 and which connects the first flat surface 208 and the tapered nose 201. The first flat surface 208 further includes a first long edge 214 running between the proximate edge 210 and the distal edge 212. The first flat surface 208 also includes a second long edge 216, running between the proximate edge 210 and the distal edge 212. Thus, the proximate edge 210, the first long edge 214, the distal edge 212, and the second long edge 216 outline a flat area that is the first flat surface 208. The elongated body additionally has a first curved surface 218, which has a curved edge 219 located at the proximate end of the elongated body, and a second curved surface 220, which also has a curved edge 221 located at the proximate end of the elongated body, the curved surfaces 218 and 220 forming the sides of the elongated body 202.

Figure 2C:
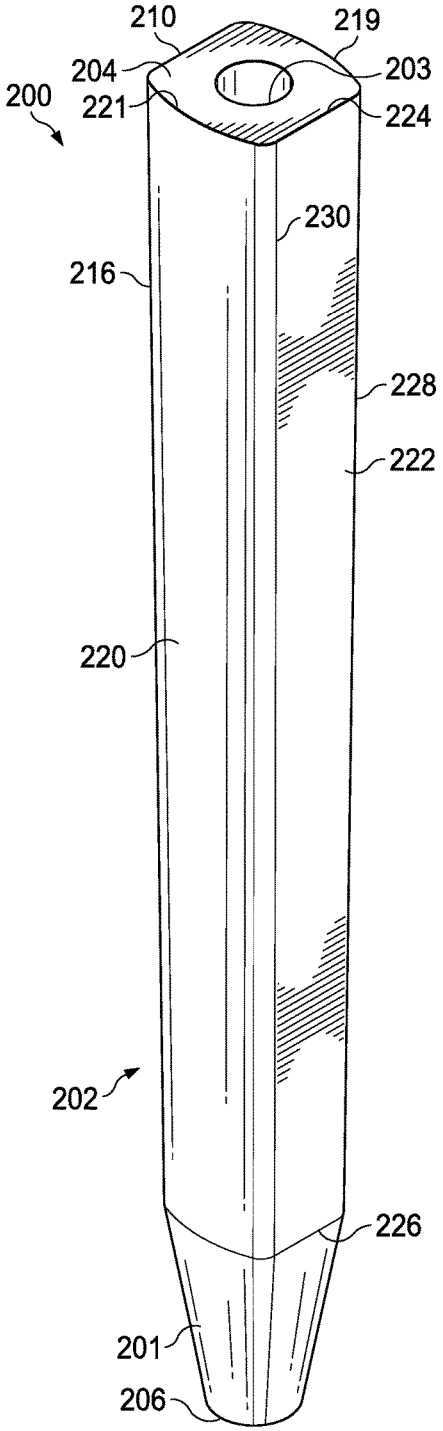
FIG. 2C illustrates a side perspective view of the golf putter grip of FIGS. 2A-2B.
Figure 2B:
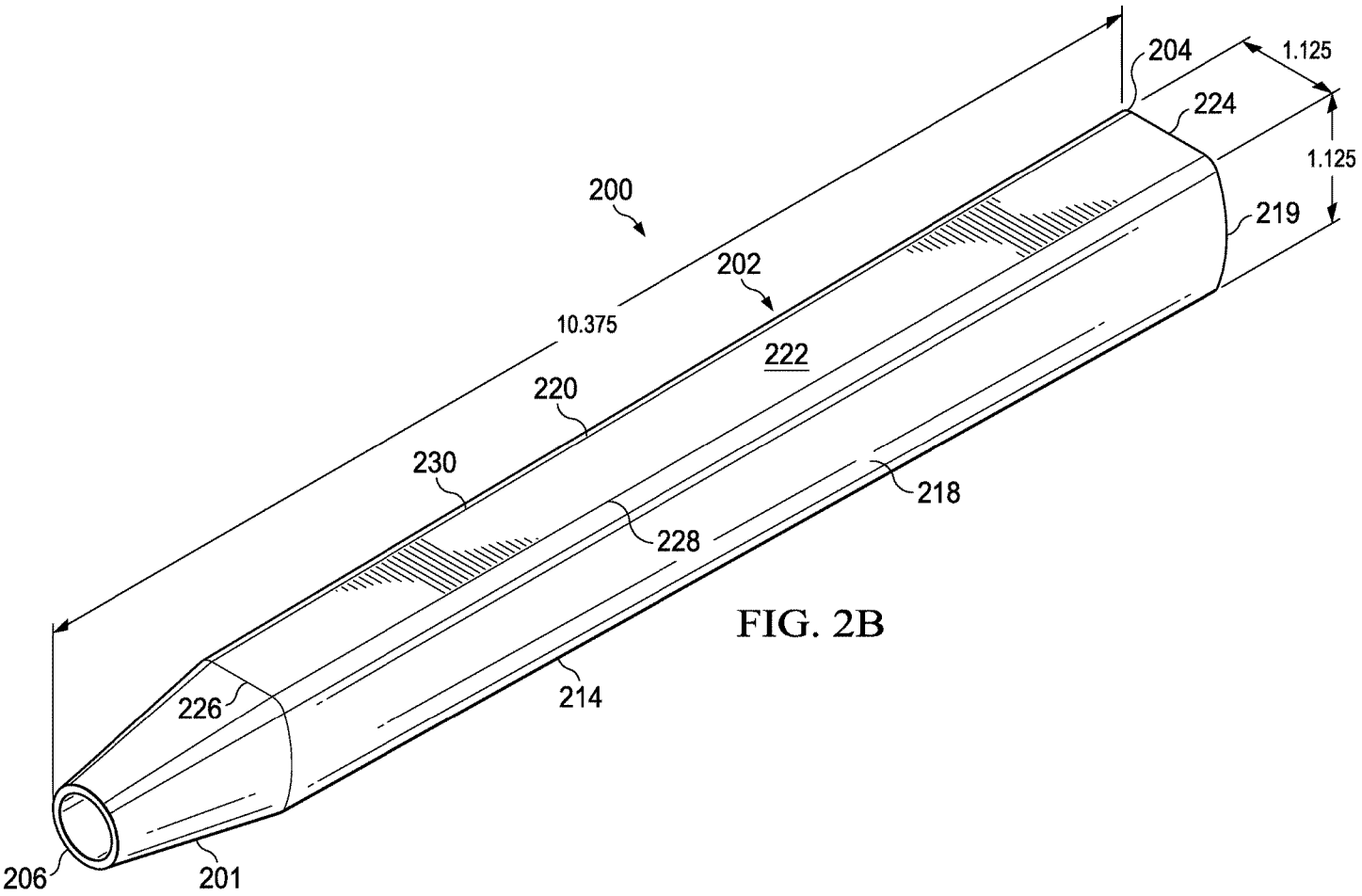
FIG. 2B illustrates a bottom perspective view of the golf putter grip of FIG. 2A.

Referring now to FIG. 2B, there is illustrated a bottom perspective view of the golf putter grip 200. There is shown that the elongated body 202 is 10.375 inches measures from the proximate end 204 to the distal end 206. The elongated body 202 further includes a second flat surface 222. The second flat surface 222 may define a center line disposed in the center of the second flat surface 222 and running longitudinally across the second flat surface 222. The second flat surface, similarly to the first flat surface, has a proximate edge 224 and a distal edge 226, the distal edge 226 located near the distal end 206 and connecting the second flat surface 222 and the tapered nose 201. The second flat surface 222 further includes a first long edge 228 running between the proximate edge 224 and the distal edge 226 of the second flat surface 222. The second flat surface 222 also includes a second long edge 230, running between the proximate edge 224 and the distal edge 226. Thus, the proximate edge 224, the first long edge 228, the distal edge 226, and the second long edge 230 outline a flat area that is the second flat surface 222. The first curved surface 218 lies between the first long edge 214 of the first flat surface 208 and the first long edge 228 of the second flat surface 222. Further, the curved edge 219 of the first curved surface 218 runs between and connects the proximate edge 210 of the first flat surface 208 and the proximate edge 224 of the second flat surface 222.

Referring now to FIG. 2C, there is illustrated a side perspective view of the golf putter grip 200. There is shown the second curved surface 220 lying between the second long edge 216 of the first flat surface 208 and the second long edge 230 of the second flat surface 222. The curved edge 221 of the second curved surface 220 lies between and connects the proximate edge 210 of the first flat surface 208 and the proximate edge 224 of the second flat surface 222. The proximate end 204 is shown having a hole 203 extending from the proximate end 204 through the distal end 206, through which a golf club shaft may be inserted. It will be appreciated that, for all embodiments of the present disclosure, the hole 203 does not have to be disposed directly in the center of the proximate end 204, but may be disposed anywhere on the proximate end 204 to allow for different placements of the shaft through the golf putter grip.

Figure 2D:
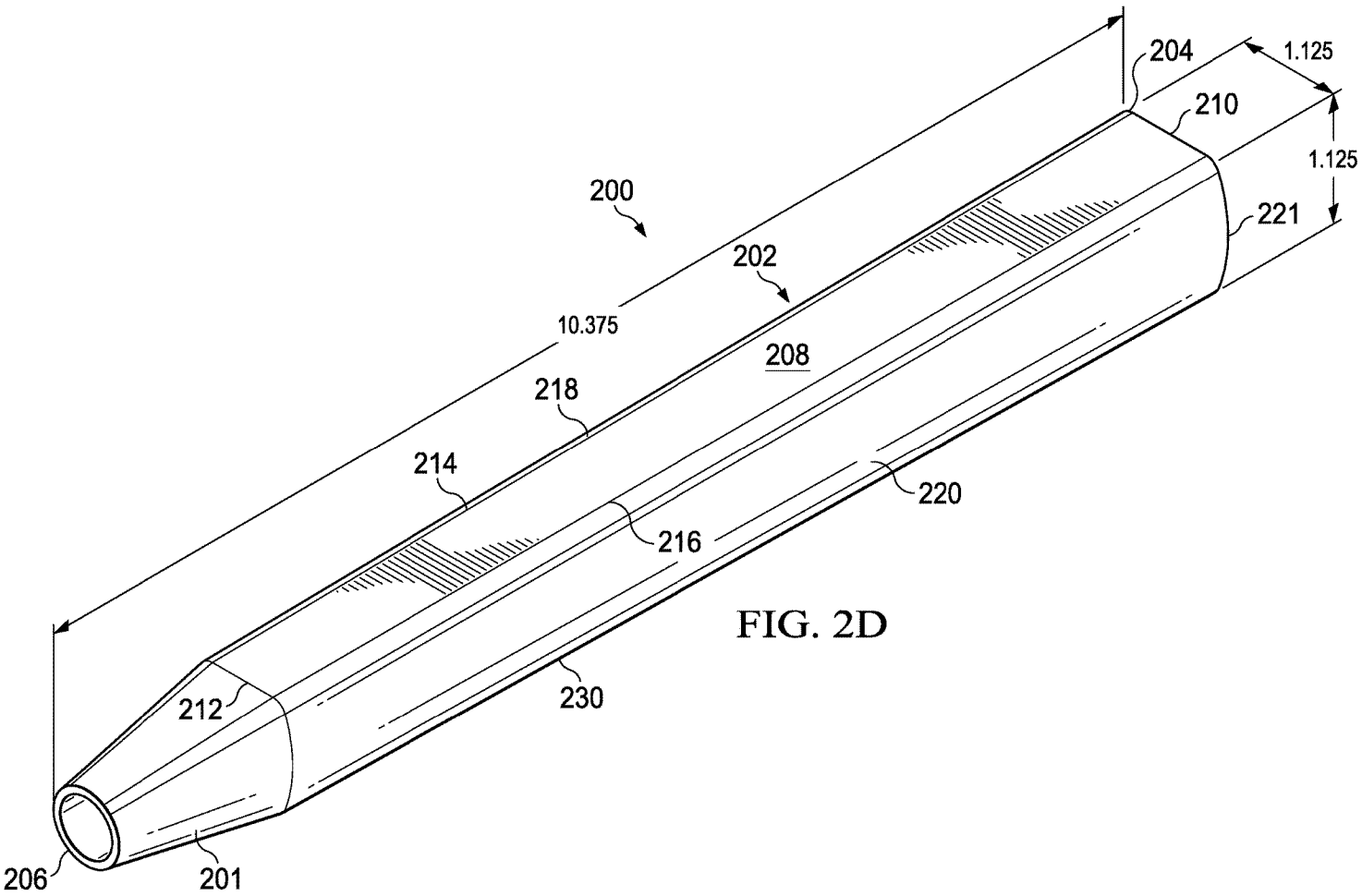
FIG. 2D illustrates a top perspective view of the golf putter grip of FIGS. 2A-2C.

Referring now to FIG. 2D, there is illustrated a top perspective view of the golf putter grip 200. There is shown that the elongated body 202 is 10.375 inches measures from the proximate end 204 to the distal end 206. There is shown the first flat surface 208, having the proximate edge 210 and a distal edge 212, the distal edge 212 located near the distal end 206 and connecting the first flat surface 208 and the tapered nose 201. There is also shown the first flat surface 208 including the first long edge 214 running between the proximate edge 210 and the distal edge 212 of the first flat surface 208. There is further shown the first flat surface 208 including the second long edge 216, running between the proximate edge 210 and the distal edge 212. The second curved surface 220 lies between the second long edge 216 of the first flat surface 208 and the second long edge 230 of the second flat surface 222. Further, the curved edge 221 of the second curved surface 220 runs between and connects the proximate edge 210 of the first flat surface 208 and the proximate edge 224 of the second flat surface 222.

Figure 2E:
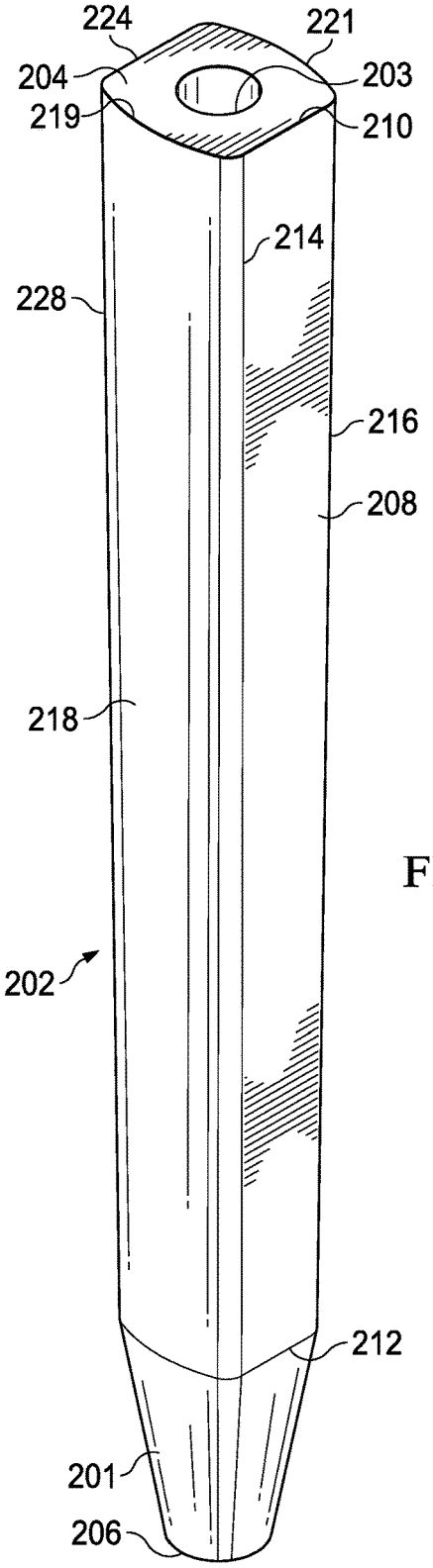
FIG. 2E illustrates another side perspective view of the golf putter grip of FIGS. 2A-2D.

Referring now to FIG. 2E, there is illustrated another side perspective view of the golf putter grip 200. There is shown the first curved surface 218 lying between the first long edge 214 of the first flat surface 208 and the first long edge 228 of the second flat surface 222. The curved edge 219 of the first curved surface 218 lies between and connects the proximate edge 210 of the first flat surface 208 and the proximate edge 224 of the second flat surface 222. The proximate end 204 is again shown having a hole 203, through which a golf club shaft may be inserted.

Figure 2F:
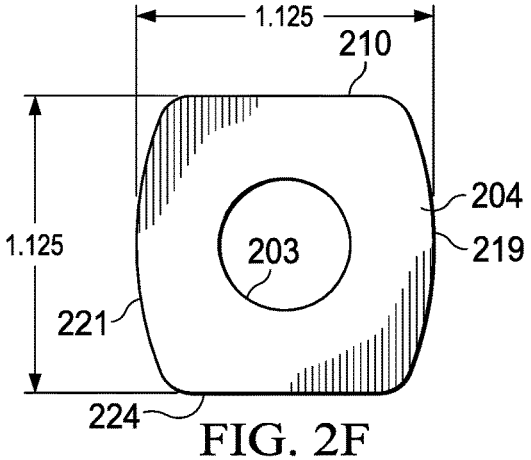
FIG. 2F illustrates a view of a proximate end of the golf putter grip of FIGS. 2A-2E.

Referring now to FIG. 2F, there is illustrated a view of the proximate end 204 of the golf putter grip 200. There is shown the proximate edge 210 of the first flat surface 208, the proximate edge 224 of the second flat surface 222, the curved edge 219 of the first curved surface 218, the curved edge 221 of the second curved surface 220, and the hole 203. FIG. 2F further shows the dimensions in inches of the proximate end 204 for the illustrative embodiment. There is shown that the width of the proximate end 204 is 1.125 inches measured from the outermost point of the curved edge 219 to the outermost point of the curved edge 221. There is also shown the height of the proximate end 204 at 1.125 inches, measured between the two proximate edges 210 and 224. Thus, there is a 1:1 ratio between the width and the height of the proximate end 204. The ratio of the illustrative embodiment provides a grip that does not move within the hand, thus providing for a tighter and more effective grip. It will be appreciated by one skilled in the art that, in other embodiments, other dimensions may be used and different ratios may be achieved, depending on the style of grip desired and the needs of the user of the grip.

Figure 2G:
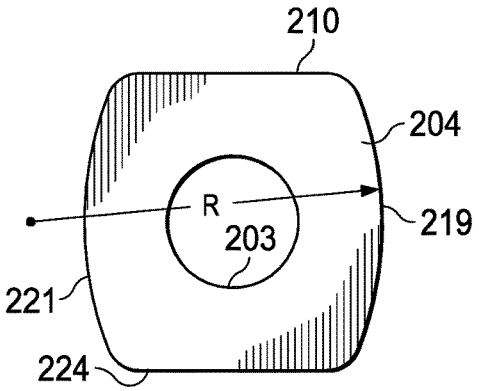
FIG. 2G illustrates another view of the proximate end of the golf putter grip of FIGS. 2A-2F.

Referring now to FIG. 2G, there is illustrated another view of the proximate end 204 of the golf putter grip 200. There is again shown the proximate edge 210 of the first flat surface 208, the proximate edge 224 of the second flat surface 222, the curved edge 219 of the first curved surface 218, the curved edge 221 of the second curved surface 220, and the hole 203. FIG. 2G further shows the radius of curvature ("R") of the curved edge 219. It will be appreciated that the radius of curvature of the curved edge 221 would be equal to that shown for curved edge 219, as the curved edges 219 and 221 are equal in dimensions. It will also be appreciated that the radius of curvature may be different if different dimensions of the proximate end 204 are desired.

Figure 2H:
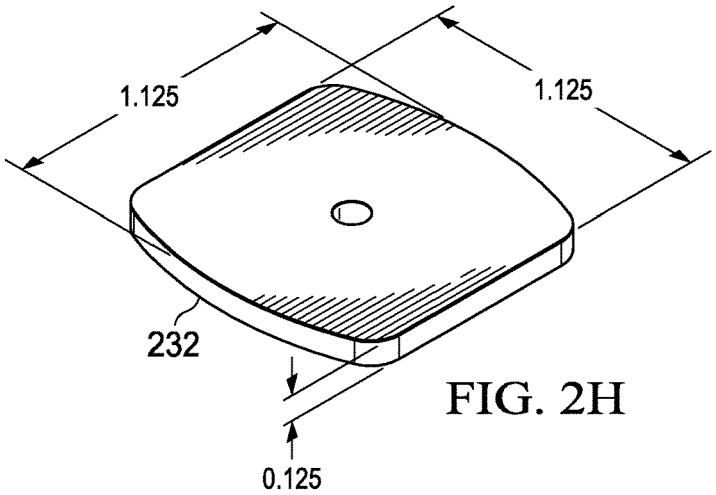
FIG. 2H illustrates an endcap for the golf putter grip of FIGS. 2A-2G.

Referring now to FIG. 2H, there is illustrated an endcap 232 for the golf putter grip 200. The endcap 232 is designed to fit onto the proximate end 204 of the golf putter grip 200 so as to provide a covering over the hole 203. In one embodiment, the width is 1.125, the length is 1.125, and the thickness is 0.125.

Figure 3A:
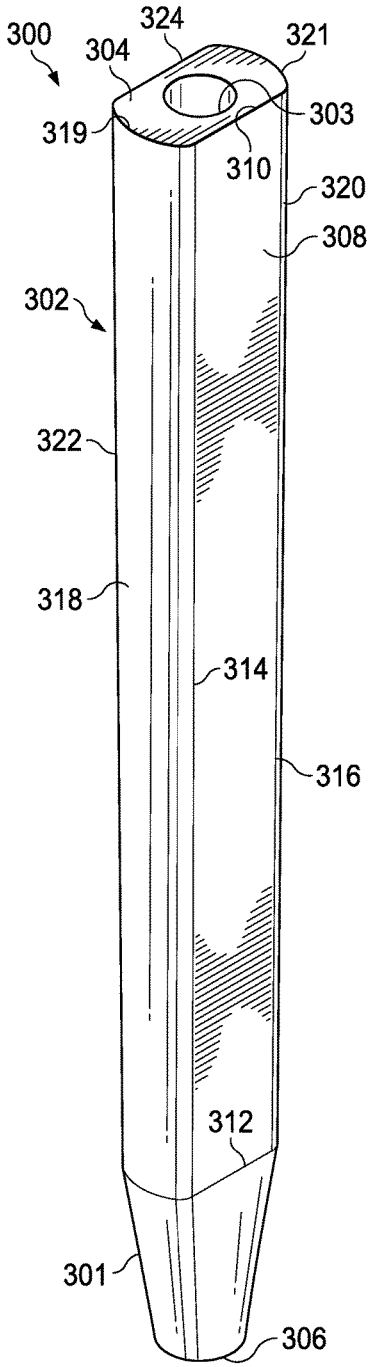
FIG. 3A illustrates a top perspective view of another embodiment of a golf putter grip.

Referring now to FIG. 3A, there is illustrated a top perspective view of another embodiment of a golf putter grip 300, wherein proximate edges 310 and 324 are wider than the proximate edges 210 and 224 shown in FIGS. 2A-2G. The golf putter grip 300 has an elongated body 302. The elongated body 302 includes a proximate end 304 having a hole 303 for a golf club shaft, and a tapered nose 301 opposite the proximate end and ending in a distal end 306. The elongated body 302 further includes a first flat surface 308, a first curved surface 318, a second curved surface 320, and a second flat surface 322. The first flat surface 308 includes a proximate edge 310, a distal edge 312, a first long edge 314 running between the proximate edge 310 and the distal edge 312, and a second long edge 316 spaced apart from the first long edge 314 and running between the proximate edge 310 and the distal edge 312. The second flat surface 322 is positioned on the opposite side of the elongated body 302 and includes the same features as the first flat surface 308, including the depicted proximate edge 324. The first curved surface 318 includes a curved edge 319, running between and connecting the proximate edge 310 of the first flat surface 308 and the proximate edge 304 of the second flat surface 322, and is connected to and lies between the first flat surface 308 and the second flat surface 322.

Figure 3B:
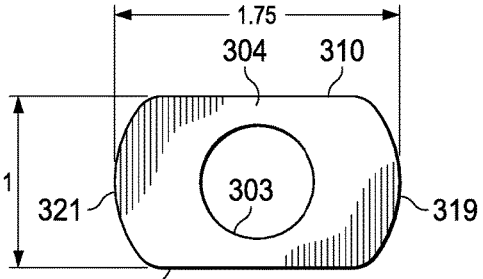
FIG. 3B illustrates a view of a proximate end of the golf putter grip of FIG. 3A.

Referring now to FIG. 3B, there is illustrated a view of the proximate end 304 of the of the golf putter grip 300. The proximate end 304 again includes the hole 303, the proximate edge 310 of the first flat surface 308, the proximate edge 324 of the second flat surface 322 positioned on the opposite side of the proximate end 304 from the proximate edge 310, the curved edge 319 of the first curved surface 318, and the curved edge 321 of the second curved surface 320 positioned on the opposite side of the curved edge 319. FIG. 3B further shows the dimensions in inches of the proximate end 304 for the illustrative embodiment. There is shown that the width of the proximate end 304 is 1.75 inches measured from the outermost point of the curved edge 319 to the outermost point of the curved edge 321. There is also shown the height of the proximate end 304 at 1 inch, measured between the two proximate edges 310 and 324. Thus, there is a ratio of 1.75 between the width and the height of the proximate end 204. The ratio of the illustrative embodiment provides a grip that does not move within the hand, thus providing for a tighter and more effective grip. It will be appreciated by one skilled in the art that, in other embodiments, other dimensions may be used and different ratios may be achieved, depending on the style of grip desired and the needs of the user of the grip.

Figure 3C:
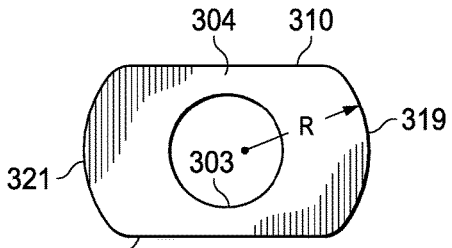
FIG. 3C illustrates another view of the proximate end of the golf putter grip of FIGS. 3A-3B.

Referring now to FIG. 3C, there is illustrated another view of the proximate end 304 of the golf putter grip 300. There is again shown the proximate edge 310 of the first flat surface 308, the proximate edge 324 of the second flat surface 322, the curved edge 319 of the first curved surface 318, the curved edge 321 of the second curved surface 320, and the hole 303. FIG. 3C further shows the radius of curvature ("R") of the curved edge 319. It will be appreciated that the radius of curvature of the curved edge 321 would be equal to that shown for curved edge 319, as the curved edges 319 and 321 are equal in dimensions. It will also be appreciated that the radius of curvature may be different if different dimensions of the proximate end 304 are utilized.

Figure 4A:
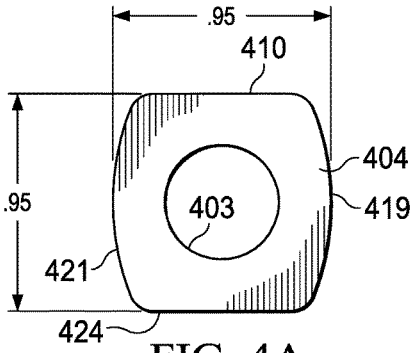
FIG. 4A illustrates a view of a proximate end of another embodiment of a golf putter grip.

Referring now to FIG. 4A, there is illustrated a view of a proximate end 404 of another embodiment of a golf putter grip. There is shown a proximate edge 410 of a first flat surface, a proximate edge 424 of a second flat surface, a curved edge 419 of a first curved surface, a curved edge 421 of a second curved surface, and a hole 403. FIG. 4A further shows the dimensions in inches of the proximate end 404 for the illustrative embodiment. There is shown that the width of the proximate end 404 is 0.95 inches measured from the outermost point of the curved edge 419 to the outermost point of the curved edge 421. There is also shown the height of the proximate end 404 at 0.95 inches, measured between the two proximate edges 410 and 424. Thus, there is a 1:1 ratio between the width and the height of the proximate end 404. This embodiment shows that different dimensions may be used for the golf putter grip of the present disclosure. The ratio of the illustrative embodiment provides a grip that does not move within the hand, thus providing for a tighter and more effective grip. It will be appreciated by one skilled in the art that, in other embodiments, other dimensions may be used and different ratios may be achieved, depending on the style of grip desired and the needs of the user of the grip.

Figure 4B:
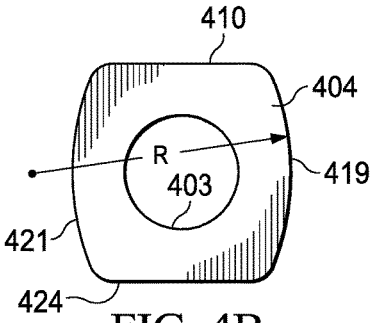
FIG. 4B illustrates another view of the proximate end of the golf putter grip of FIG. 4A.

Referring now to FIG. 4B, there is illustrated another view of the proximate end 404. There is again shown the proximate edge 410 of the first flat surface, the proximate edge 424 of the second flat surface, the curved edge 419 of the first curved surface, the curved edge 421 of the second curved surface, and the hole 403. FIG. 4B further shows the radius of curvature ("R") of the curved edge 419. It will be appreciated that the radius of curvature of the curved edge 421 would be equal to that shown for curved edge 419, as the curved edges 419 and 421 are equal in dimensions. It will also be appreciated that the radius of curvature may be different if different dimensions of the proximate end 404 are utilized.

Figure 5A:
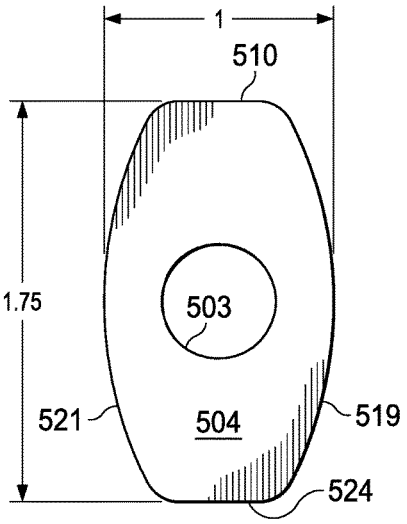
FIG. 5A illustrates a view of a proximate end of yet another embodiment of a golf putter grip.

Referring now to FIG. 5A, there is illustrated a view of a proximate end 504 of another embodiment of a golf putter grip. There is shown a proximate edge 510 of a first flat surface, a proximate edge 524 of a second flat surface, a curved edge 519 of a first curved surface, a curved edge 521 of a second curved surface, and a hole 503. FIG. 5A further shows the dimensions in inches of the proximate end 504 for the illustrative embodiment. There is shown that the width of the proximate end 504 is 1 inch measured from the outermost point of the curved edge 519 to the outermost point of the curved edge 521. There is also shown the height of the proximate end 504 at 1.75 inches, measured between the two proximate edges 510 and 524. Thus, there is a ratio of approximately 0.57 between the width and the height of the proximate end 504. This embodiment shows that different dimensions may be used for the golf putter grip of the present disclosure. The ratio of the illustrative embodiment provides a grip that does not move within the hand, thus providing for a tighter and more effective grip. It will be appreciated by one skilled in the art that, in other embodiments, other dimensions may be used and different ratios may be achieved, depending on the style of grip desired and the needs of the user of the grip.

Figure 5B:
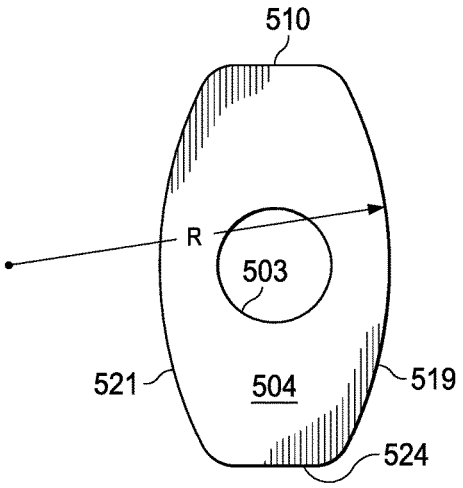
FIG. 5B illustrates another view of the proximate end of the golf putter grip of FIG. 5A.

Referring now to FIG. 5B, there is illustrated another view of the proximate end 504. There is again shown the proximate edge 510 of the first flat surface, the proximate edge 524 of the second flat surface, the curved edge 519 of the first curved surface, the curved edge 521 of the second curved surface, and the hole 503. FIG. 5B further shows the radius of curvature ("R") of the curved edge 519. It will be appreciated that the radius of curvature of the curved edge 521 would be equal to that shown for curved edge 519, as the curved edges 519 and 521 are equal in dimensions. It will also be appreciated that the radius of curvature may be different if different dimensions of the proximate end 504 are utilized.

Figure 6:
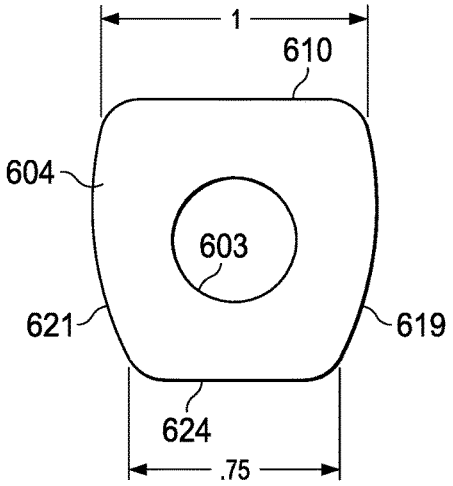
FIG. 6 illustrates a view of a proximate end of yet another embodiment of a golf putter grip.

Referring now to FIG. 6, there is illustrated a view of a proximate end 604 of another embodiment of a golf putter grip. There is shown a proximate edge 610 of a first flat surface, a proximate edge 624 of a second flat surface, a curved edge 619 of a first curved surface, a curved edge 621 of a second curved surface, and a hole 603. FIG. 6 further shows the dimensions in inches of the proximate end 604 for the illustrative embodiment. There is shown that the width of the proximate edge 610 is 1 inch. There is also shown that the width of the proximate edge 624 is 0.75 inches. Thus, the proximate edge 610 and the proximate edge 624 are of unequal lengths. This embodiment demonstrates that different dimensions may be used for the golf putter grip of the present disclosure.

As FIGS. 2A-6 show, various proportions of the golf club grip of the present disclosure providing for different ratios between the proximate edges and curved edges, as well as different lengths of the elongated body, can be used for the golf putter grip, with the common features being the flat surfaces and curved surfaces. The proximate edges of the proximate end may be of variable length, while the curved edges of the proximate end may also consist of variable lengths and have various radiuses of curvature so as to fit the desired style of the grip or the needs of the user of the grip. It will also be appreciated that the radiuses of curvature of the curved edges may not be equal. For instance, a person with a smaller thumb, such as a woman, may need a grip with shorter proximate edges of the proximate end so that the thumb fits more appropriately on the first flat surface without excess surface area on either side of the thumb. Similarly, someone with a smaller hand might require a grip that has narrower curved edges of the proximate end so that the grip is not too large for the person's hand to wrap around. Alternatively, a person with a larger hand and thumb may require a grip with longer proximate edges and longer curved edges so that the thumb is not too large for the flat surface areas and so that the grip is not too small for the person's hand.

Regarding various radiuses of curvature, the proximate end, such as proximate end 204 in FIG. 2G, may be envisioned as a rectangle with the side edges forming a secant line running through a circle. This secant line defines the arc that is the curved edges, such as curved edge 219 and 221 of FIG. 2G. Similar shapes, such as ellipses, may also be used. The curved edges do not have to form a perfect arc as that found in a circle. The length of the radius of curvature may deviate greatly between embodiments. Thus, the range of curvature could range between as small as 0.25 inches and as large as 8 inches. This allows the curved edges to be wide arcs, or narrow arcs, depending on the chosen design.

Figure 7A:
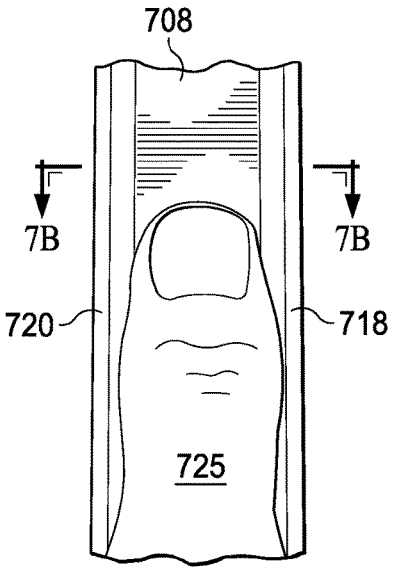
FIG. 7A illustrates one embodiment of a placement of a user's thumb on a golf putter grip.

Referring now to FIG. 7A, there is illustrated one embodiment of a placement of a user's thumb 725 on a golf putter grip. The user's thumb 725 is placed on the first flat surface 708, with the pad of the user's thumb 725 pressed against the first flat surface 708. The tip of the user's thumb 725 points down the golf putter grip towards a distal end of the golf putter grip, with a first curved surface 718 and a second curved surface 720 disposed on either side of the first flat surface 708 and the user's thumb 725.

Figure 7B:
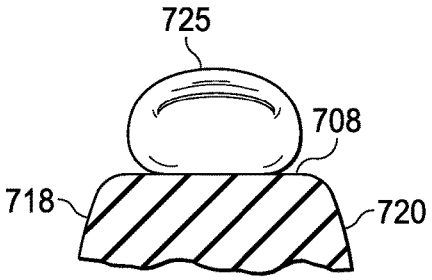
FIG. 7B illustrates another view of the placement of the user's thumb on the golf putter grip of FIG. 7A.

Referring now to FIG. 7B, there is illustrated another view of the placement of the user's thumb 725 on the golf putter grip of FIG. 7A. FIG. 7B shows that the pad of the user's thumb 725 is pressed flat against the first flat surface 708. Preferably, the sides of the user's thumb 725 would not extend over the boundaries of the first flat surface 708 and, thus, would not touch or be positioned above the first curved surface 718 or the first curved surface 720.

Figure 8A:
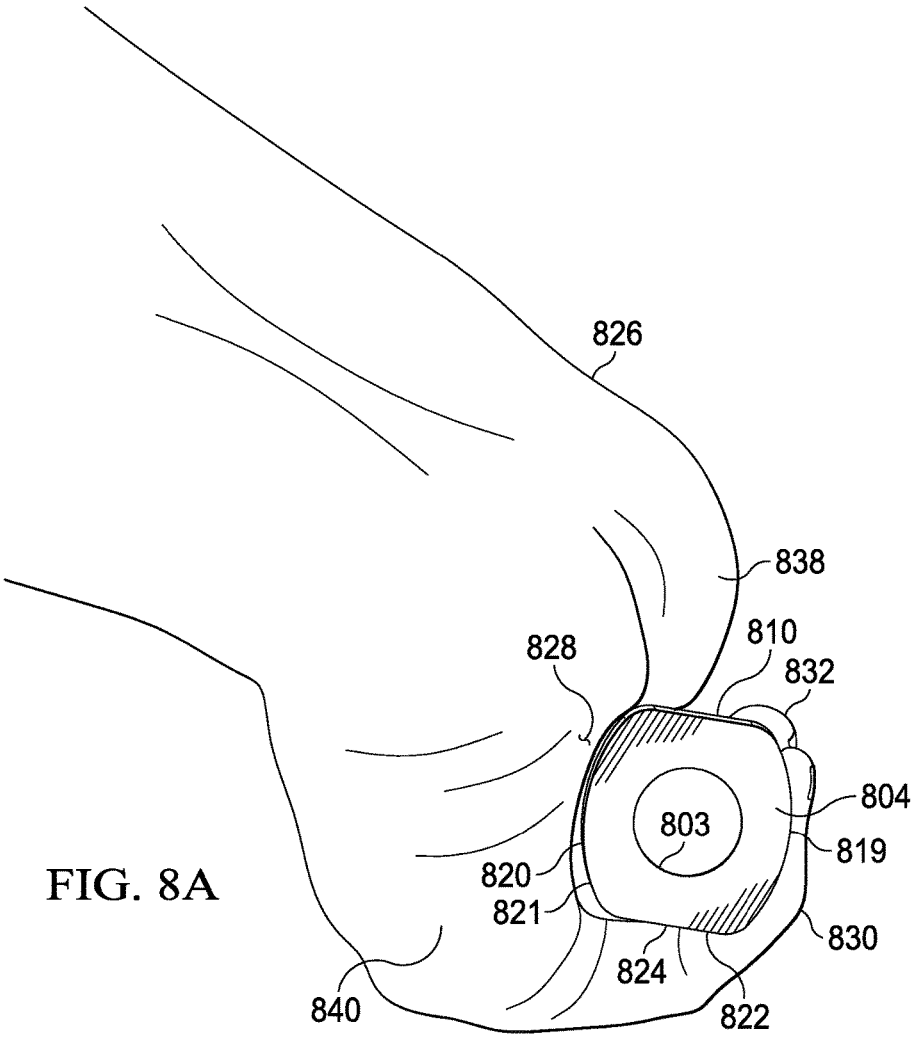
FIG. 8A illustrates a view of a proximate end of one embodiment of a golf putter grip held in a user's hand.
Figure 8B:
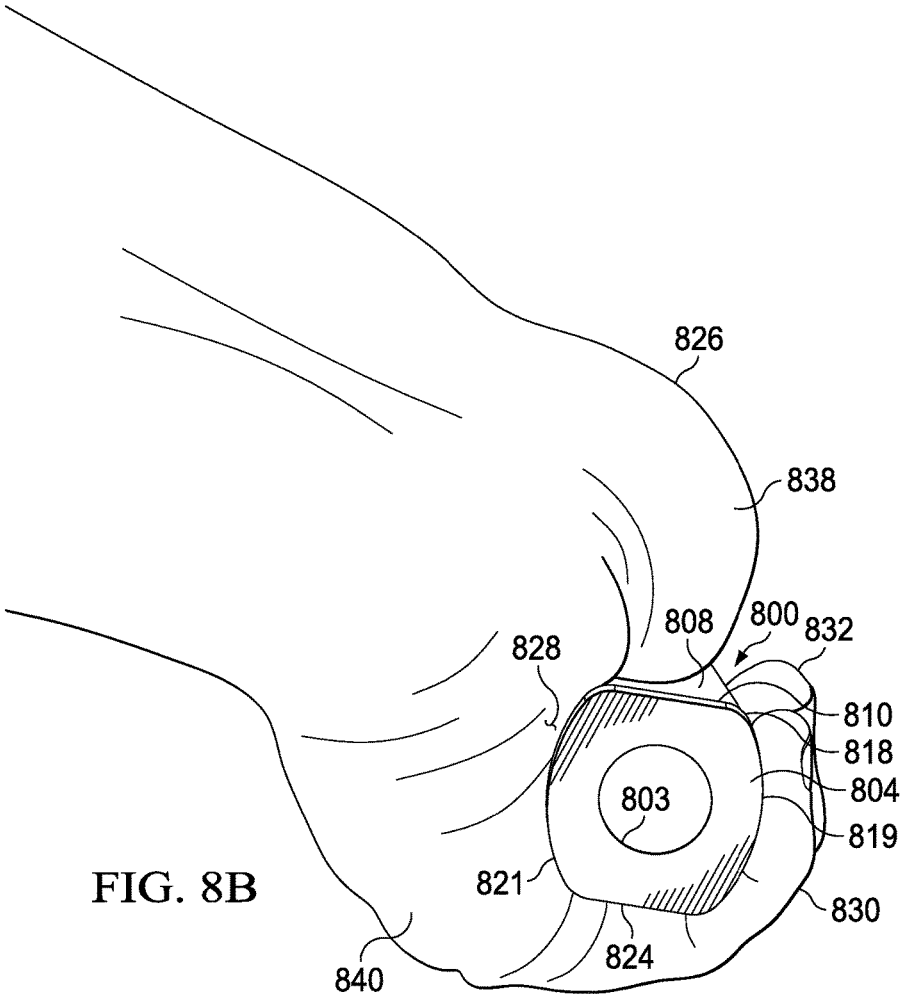
FIG. 8B illustrates another view of the golf putter grip held in the user's hand of FIG. 8A.

Referring now to FIGS. 8A and 8B, there is illustrated views of a proximate end 804 of one embodiment of a golf putter grip 800 held in a user's hand 826. A user's thumb 825 is extended down the length of a first flat surface 808 of the grip 800, causing a thenar 838 of the user's hand 826 to contact the first flat surface 808. A second flat surface 822 of the grip 800 lays across proximal phalanxes of the fingers of the user's hand 826, as shown in FIG. 8A where the second flat surface 822 lays across a small finger 830, or pinky, and a ring finger 832 of the user's hand 826. Remaining portions of the fingers of the user's hand 826 that do not contact the second flat surface 822 curl around a first curved surface 818. A second curved surface 820 contacts the palm 828 of the user's hand 826. The proximate end 804, having a hole 803, proximate edges 810 and 824, and curved edges 819 and 821, preferably is flush with the hypothenar 840 of the user's hand, or extending slightly behind the hypothenar 840. The design of the grip of the present disclosure allows for a maximum amount of surface area of the user's hand 826 to contact the grip 800, so as to provide for optimum grip and control.

Figure 8C:
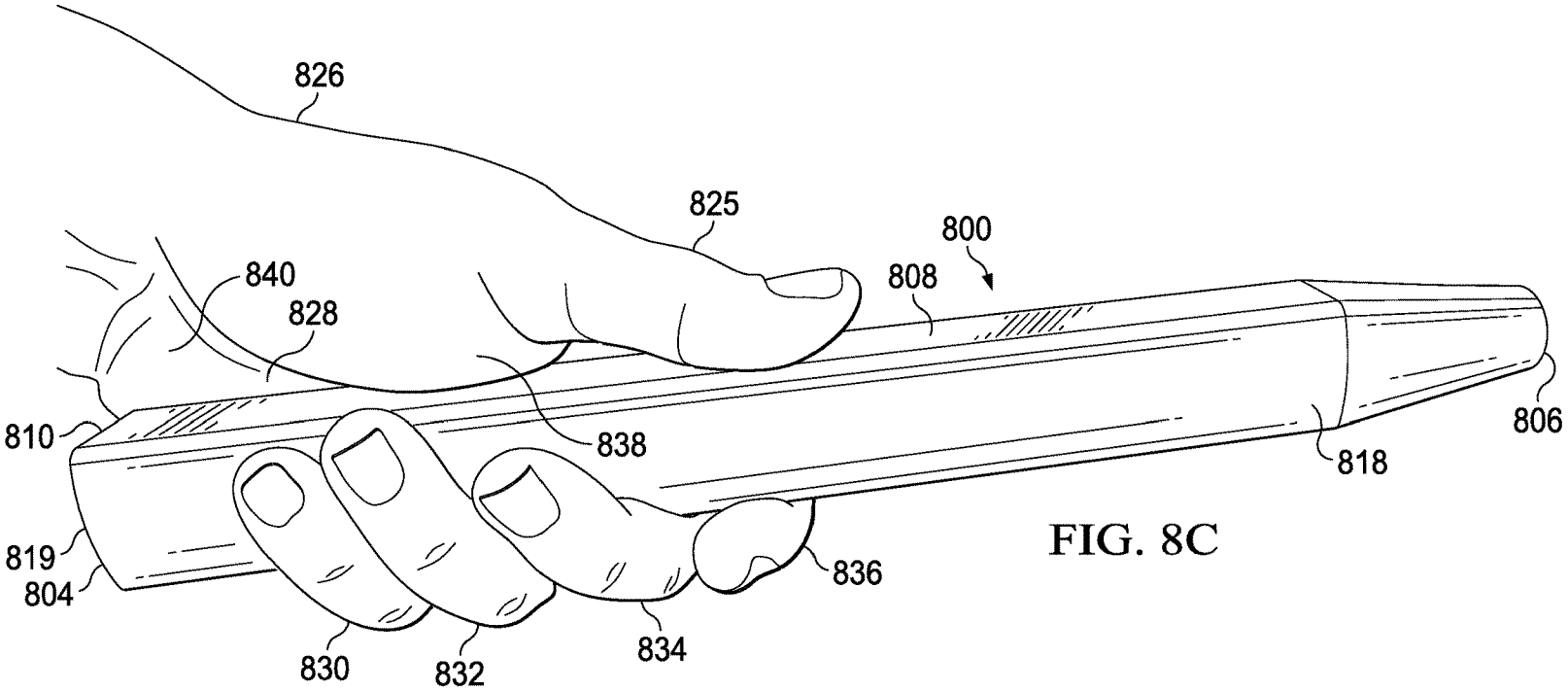
FIG. 8C illustrates a side perspective view of the golf putter grip held in the user's hand of FIGS. 8A-8B.

Referring now to FIG. 8C, there is illustrated a side perspective view of the golf putter grip 800 held in the user's hand 826. There is shown that the pad of the thumb 825, opposite the nail, of the user's hand 826 contacts the first flat surface 808 and extends towards a distal end 806 of the grip 800. The grip 800 lays across the small finger 830, the ring finger 832, a middle finger 834, and an index finger 836 of the user's hand 826, with the small finger 830 being nearest the proximate end 804 and the index finger 836 being nearest the distal end 806.

Figure 8D:
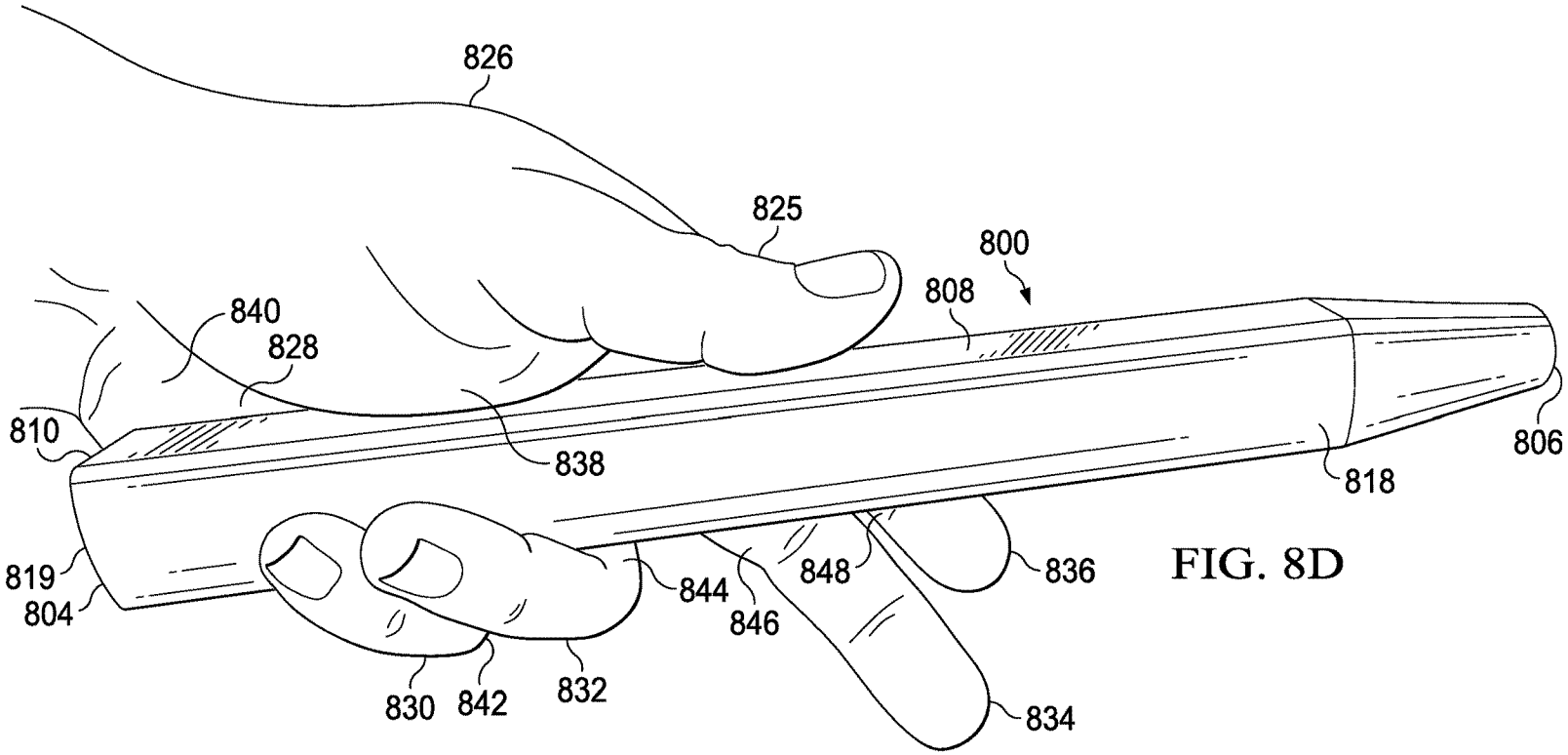
FIG. 8D illustrates another side perspective view of the golf putter grip held in the user's hand.

Referring now to FIG. 8D, there is illustrated another side perspective view of the golf putter grip 800 held in the user's hand 826. There is shown in FIG. 8D the middle finger 834 and the index finger 836 uncurled and extended downward, for purposes of demonstrating which portions of the fingers 830, 832, 834, and 836 preferably contact the grip 800. A proximal phalanx 842 of the small finger 830, a proximal phalanx 844 of the ring finger 832, and a proximal phalanx 846 of the middle finger 834 preferably contact the second flat surface 822 of the grip 800. A middle phalanx 848 of the index finger 836 preferably contacts the second flat surface 822. Thus, the second flat surface 822 of the golf putter grip 800 lays across the proximal phalanxes 842, 844, and 846 and the middle phalanx 848. It will be appreciated by those skilled in the art that FIGS. 8C and 8D would typically be directed to the user's non-dominant hand, as the non-dominant hand is typically the hand which grips the grip 800 closest to the proximate end 804. It will also be appreciated by those skilled in the art that other methods of gripping the grip 800 may be used, typically based on user preference.

Figure 8E:
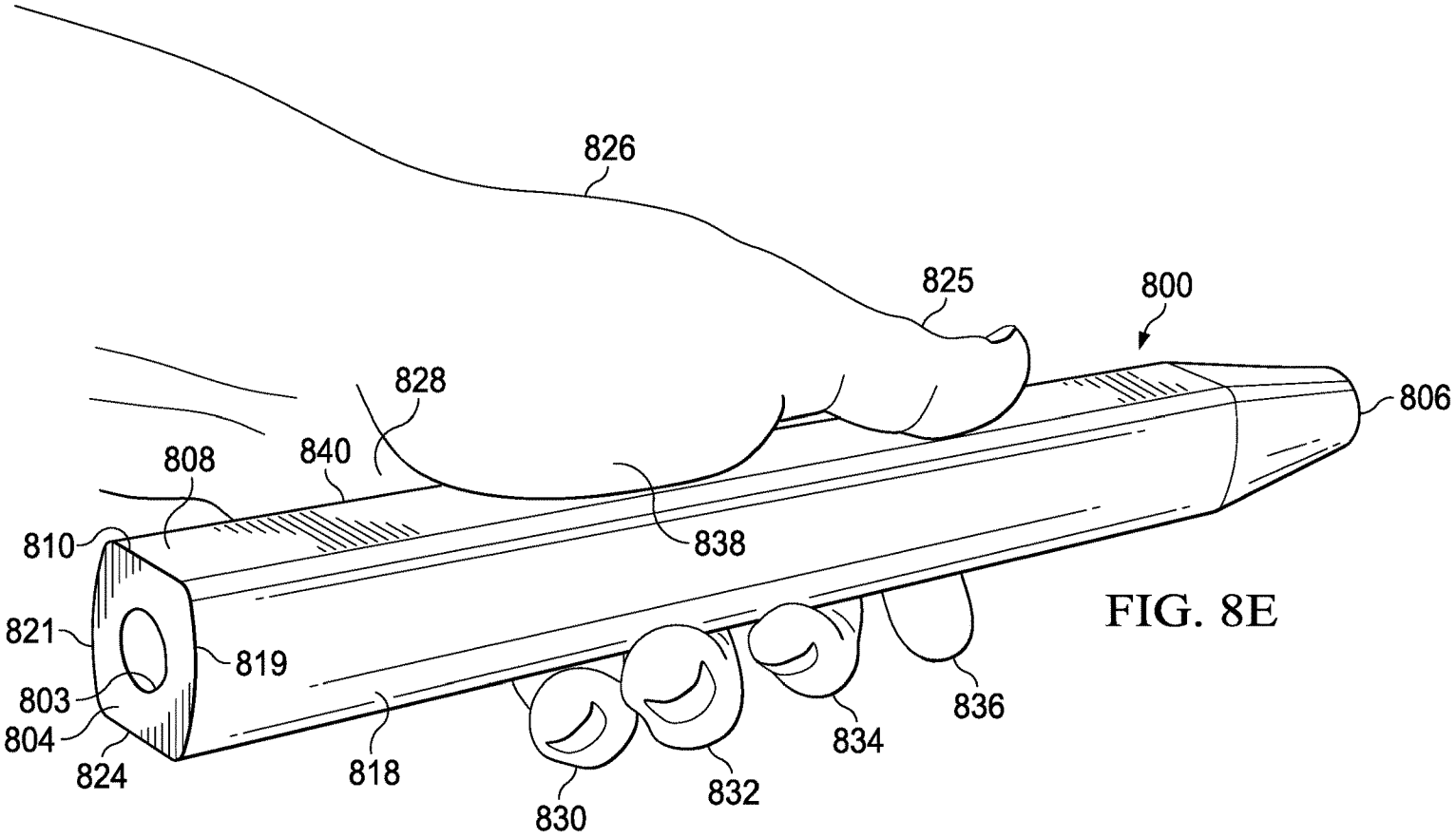
FIG. 8E illustrates another side perspective view of the golf putter grip held in the user's hand.

Referring now to FIG. 8E, there is illustrated another side perspective view of the golf putter grip 800 held in the user's hand 826. The user's hand 826 grips the grip 800 further down the grip towards the distal end 806. This is to demonstrate either a user choking down on the grip 800, or to demonstrate gripping the grip 800 with the dominant hand. In the case of the dominant hand gripping the grip 800, it will be appreciated that the non-dominant hand would typically grip the grip 800 directly behind the dominant hand. The way each hand grips the grip 800 preferably does not differ from that described herein whether the user is choking down on the grip 800 or gripping the grip 800 with both hands. It will be appreciated by those skilled in the art that other methods of gripping the grip 800 may be used, typically based on user preference.

Figure 9A:
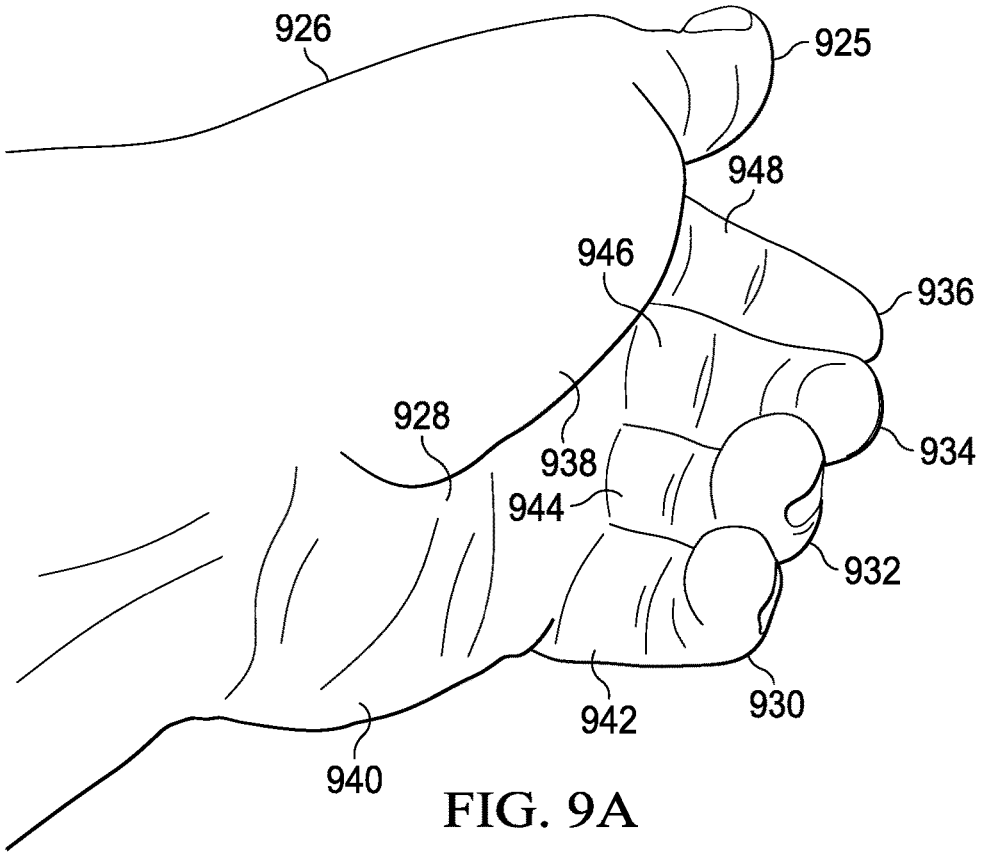
FIG. 9A illustrates a view of one embodiment of the shape of a user's hand as if a golf putter grip were in the user's hand.
Figure 9B:
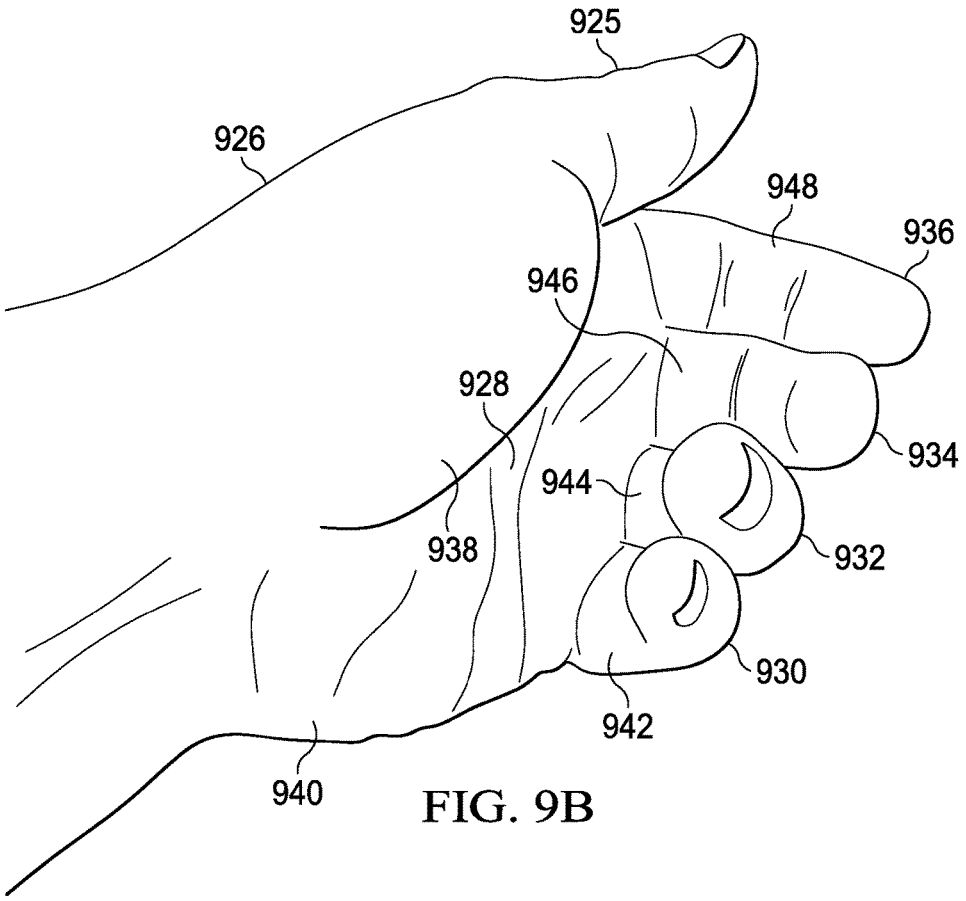
FIG. 9B illustrates another view of the shape of the user's hand of FIG. 9A.
Figure 9C:
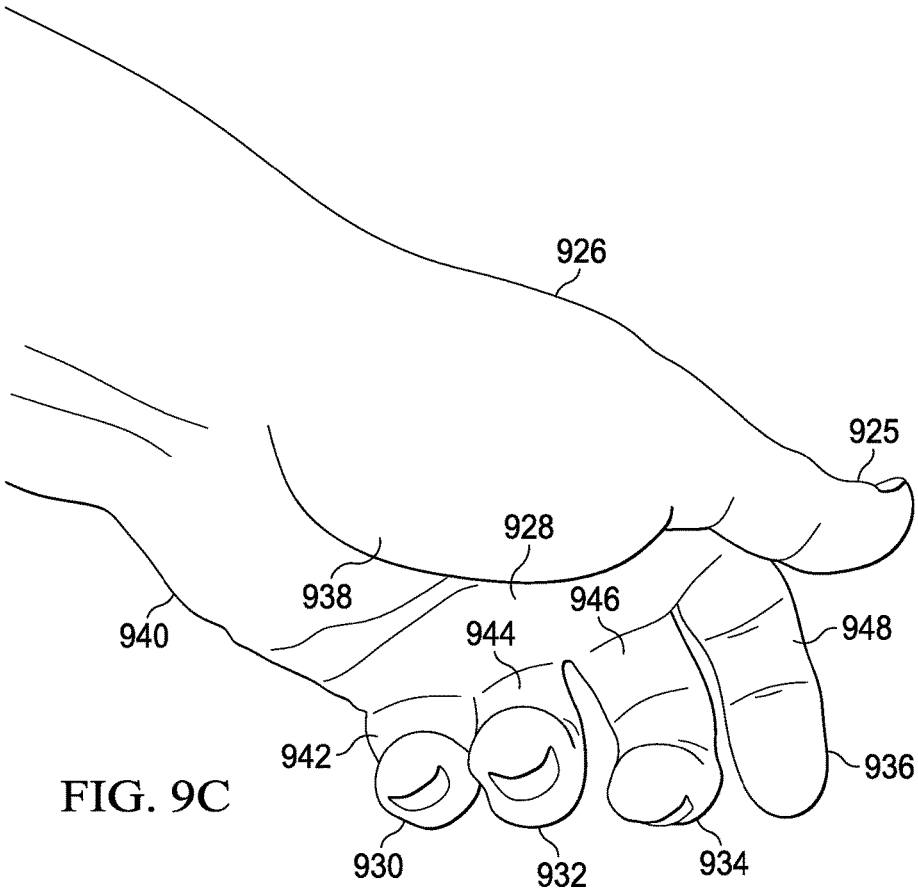
FIG. 9C illustrates another view of the shape of the user's hand of FIGS. 9A-9B.

Referring now to FIGS. 9A-9C, there is illustrated views of one embodiment of the shape of a user's hand 926 as if a golf putter grip were in the user's hand 926. A palm 928 of the user's hand 926 faces inward toward a small finger 930, a ring finger 932, a middle finger 934 and an index finger 936. A grip would lay across the fingers 930, 932, 934, and 936 such that a proximal phalanx 942 of the small finger 930, a proximal phalanx 944 of the ring finger 932, and a proximal phalanx 946 of the middle finger 934 would preferably contact a bottom flat surface of the grip. For the index finger 936, a middle phalanx 948 would preferably contact the bottom flat surface of the grip. A thenar 938 of the user's hand 926, would preferably fold inward towards the palm 928 to cause the thenar 938 and a thumb 925 to contact a top flat surface of the grip. The grip would also preferably extend to or just beyond a hypothenar 940 of the user's hand 926.

Figure 10C:
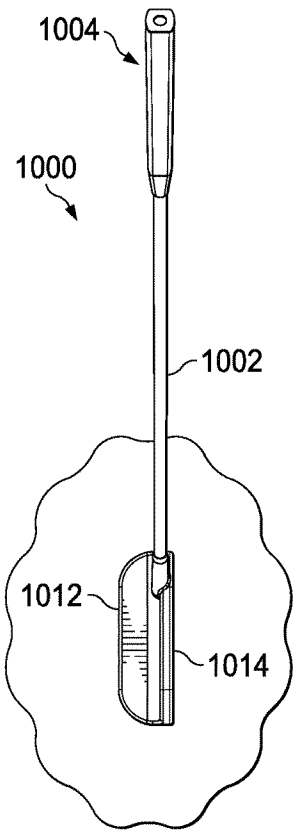
FIG. 10C illustrates a top view of one embodiment of a golf putter.
Figure 10B:
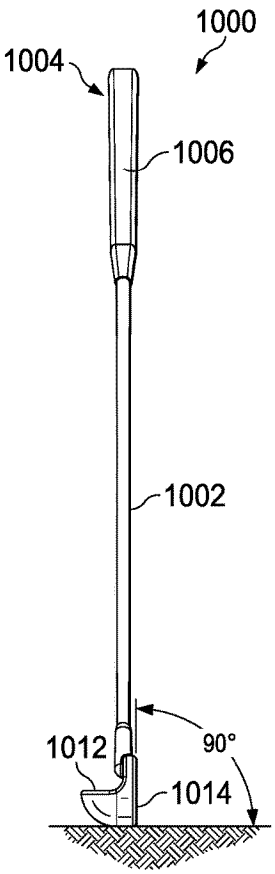
FIG. 10B illustrates a front view of one embodiment of a golf putter.
Figure 10A:
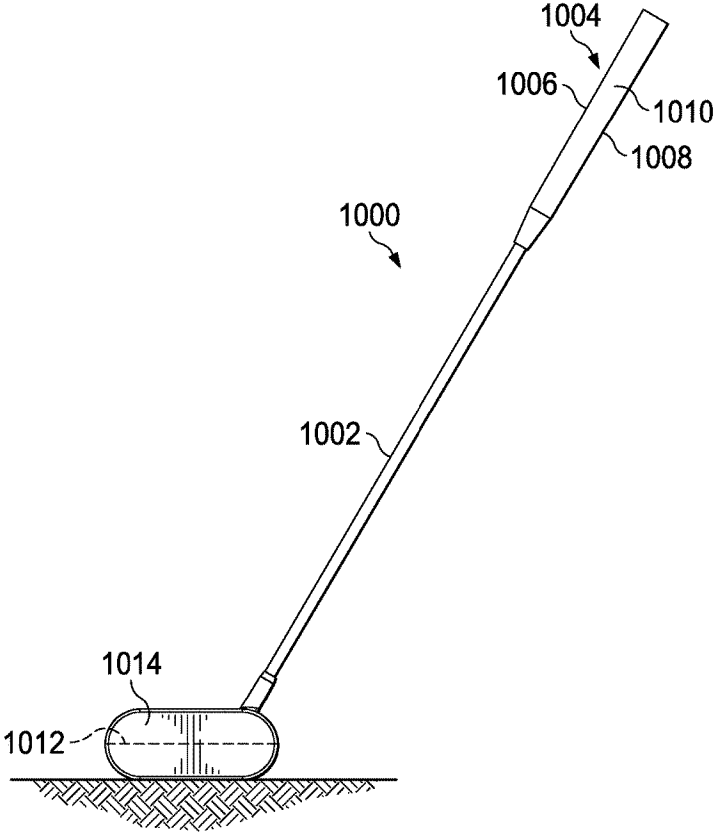
FIG. 10A illustrates a side view of one embodiment of a golf putter.

Referring now to FIGS. 10A-10C, there is illustrated various view of one embodiment of a golf putter 1000. Specifically, FIG. 10A provides a side view of the golf putter 1000, FIG. 10B provides a front view of the golf putter 1000, and FIG. 10C provides a top view of the golf putter 1000. The golf putter 1000 includes a shaft 1002, a grip 1004 connected to the top of the shaft 1002 and having a top flat surface 1006, a bottom flat surface 1008, and curved side surfaces 1010, and a head 1012 having a striking surface 1014. When the golf putter 1000 is used, the grip 1004 is held by a user. The golf putter 1000 is held with the top flat surface 1006 oriented upwards. This orientation causes the striking surface 1014 of the head 1012 to be disposed in a general direction that is perpendicular to the ground, so as to contact a golf ball with the striking surface 1014 when the putter is swung. It will be appreciated by those skilled in the art that the angle of the striking surface 1014 itself may not be perpendicular to the ground, as the striking surface 1014 may be angled by a certain number of degrees, typically in order to provide a small amount of loft to the ball. However, the striking surface 1014 is typically still directed in a general direction that is perpendicular to the ground so as to contact a golf ball.

It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A golf club grip for attachment to a shaft of a golf club, the grip comprising:

an elongated body defining a longitudinal axis running therethrough, the elongated body including:

a proximate end;

a distal end;

a first flat surface defining a first plane and spaced apart from the longitudinal axis, the first flat surface having a proximate edge, a distal edge spaced longitudinally apart from the proximate edge, a first long edge extending between the proximate edge and the distal edge, and a second long edge spaced apart from the first long edge and extending between the proximate edge and the distal edge, the first and second long edges further defining a first center line disposed on the first plane midway therebetween, and whereby when the first center line is viewed in a direction perpendicular to the longitudinal axis, the first center line appears parallel to the longitudinal axis;

a second flat surface defining a second plane and spaced apart from both the longitudinal axis and the first flat surface, the second flat surface having a proximate edge, a distal edge spaced longitudinally apart from the proximate edge, a first long edge extending between the proximate edge and the distal edge, and a second long edge spaced apart from the first long edge and extending between the proximate edge and the distal edge, the first and second long edges further defining a second center line disposed on the second plane midway therebetween, and whereby when the first center line is viewed in a direction perpendicular to the longitudinal axis, the first center line appears parallel to the longitudinal axis;

a first curved surface having an outwardly convex curvature relative to the longitudinal axis, the first curved surface having a curved edge connected between a first intermediate curved surface and a second intermediate curved surface, wherein the first intermediate curved surface is connected between the first long edge of the first flat surface and the first curved surface and the second intermediate curved surface is connected between the first long edge of the second flat surface and the first curved surface; and a second curved surface having an outwardly convex curvature relative to the longitudinal axis, the second curved surface having a curved edge connected between a third intermediate curved surface and a fourth intermediate curved surface, wherein the third intermediate curved surface is connected between the second long edge of the first flat surface and the second curved surface and the fourth intermediate curved surface is connected between the second long edge of the second flat surface and the second curved surface.

2. The golf club grip of claim 1, wherein the first flat surface and the second flat surface are positioned on opposing sides of the elongated body.

3. The golf club grip of claim 2, wherein the first flat surface and the second flat surface are parallel.

4. The golf club grip of claim 1, wherein the radius of curvature of the first curved surface and the radius of curvature of the second curved surface are equal.

5. The golf club grip of claim 1, wherein the cross-section of the elongated body is constant.

6. The golf club grip of claim 1, wherein the first curved surface and the second curved surface have a radius of curvature between 0.25 inches and 8 inches.

7. The golf club grip of claim 1, wherein a width of the second flat surface is narrower than the width of the first flat surface.

8. The golf club grip of claim 1, wherein a ratio of a width of the proximate end, measured from the center of the curved edge of the first curved surface to the center of the curved edge of the second curved surface, to a height of the proximate end, measured from the proximate edge of the first flat surface to the proximate edge of the second flat surface, is within a range that is greater than or equal to 0.5 and less than 1.

9. The golf club grip of claim 1, the elongated body further including:

a first tapered surface having a first straight edge corresponding to the distal edge of the first flat surface, the first tapered surface narrowing in width and ending in a first arcuate edge opposite the first straight edge;

a second tapered surface having a second straight edge corresponding to the distal edge of the second flat surface, the second tapered surface narrowing in width and ending in a second arcuate edge opposite the second straight edge;

a third tapered surface having a first curved edge disposed and connected between the first straight edge of the first tapered surface and the second straight edge of the second tapered surface, the third tapered surface narrowing in width and ending in a third arcuate edge opposite the first curved edge; and a fourth tapered surface having a second curved edge disposed and connected between the first straight edge of the first tapered surface and the second straight edge of the second tapered surface, the fourth tapered surface narrowing in width and ending in a fourth arcuate edge opposite the second curved edge.

10. The golf club grip of claim 9, wherein the first, second, third, and fourth arcuate edges intersect to form an arcuate end at the distal end of the golf club grip.

11. The golf club grip of claim 10, wherein a ratio of a width of the proximate end, measured from the center of the curved edge of the first curved surface to the center of the curved edge of the second curved surface, to a height of the proximate end, measured from the proximate edge of the first flat surface to the proximate edge of the second flat surface, is within a range that is greater than or equal to 0.5 and less than 1.

12. A golf putter, the putter comprising:

a shaft;

a head fixedly connected to a lower end of the shaft;

a grip fixedly connected to an upper end of the shaft, the grip including:

an elongated body defining a longitudinal axis running therethrough, the elongated body including:

a proximate end;

a distal end;

a first flat surface defining a first plane and spaced apart from the longitudinal axis, the first flat surface having a proximate edge, a distal edge spaced longitudinally apart from the proximate edge, a first long edge extending between the proximate edge and the distal edge, and a second long edge spaced apart from the first long edge and extending between the proximate edge and the distal edge, the first and second long edges further defining a first center line disposed on the first plane midway therebetween, and whereby when the first center line is viewed in a direction perpendicular to the longitudinal axis, the first center line appears parallel to the longitudinal axis;

a second flat surface defining a second plane and spaced apart from both the longitudinal axis and the first flat surface, the second flat surface having a proximate edge, a distal edge spaced longitudinally apart from the proximate edge, a first long edge extending between the proximate edge and the distal edge, and a second long edge spaced apart from the first long edge and extending between the proximate edge and the distal edge, the first and second long edges further defining a second center line disposed on the second plane midway therebetween, and whereby when the first center line is viewed in a direction perpendicular to the longitudinal axis, the first center line appears parallel to the longitudinal axis;

a first curved surface having an outwardly convex curvature relative to the longitudinal axis, the first curved surface having a curved edge connected between a first intermediate curved surface and a second intermediate curved surface, wherein the first intermediate curved surface is connected between the first long edge of the first flat surface and the first curved surface and the second intermediate curved surface is connected between the first long edge of the second flat surface and the first curved surface; and a second curved surface having an outwardly convex curvature relative to the longitudinal axis, the second curved surface having a curved edge connected between a third intermediate curved surface and a fourth intermediate curved surface, wherein the third intermediate curved surface is connected between the second long edge of the first flat surface and the second curved surface and the fourth intermediate curved surface is connected between the second long edge of the second flat surface and the second curved surface.

13. The golf putter of claim 12, wherein the first flat surface and the second flat surface of the grip are parallel.

14. The golf putter of claim 12, wherein the radius of curvature of the first curved surface of the grip and the radius of curvature of the second curved surface of the grip are equal.

15. The golf putter of claim 12, wherein the cross-section of the elongated body of the grip is constant.

16. The golf putter of claim 12, wherein the first curved surface and the second curved surface have a radius of curvature between 0.25 inches and 8 inches.

17. The golf putter of claim 12, wherein a width of the second flat surface is narrower than the width of the first flat surface.

18. The golf putter of claim 12, wherein a ratio of a width of the proximate end of the grip, measured from the center of the curved edge of the first curved surface to the center of the curved edge of the second curved surface, to a height of the proximate end of the grip, measured from the proximate edge of the first flat surface to the proximate edge of the second flat surface, is within a range that is greater than or equal to 0.5 and less than 1.

19. The golf putter of claim 12, the elongated body further including:

a first tapered surface having a first straight edge corresponding to the distal edge of the first flat surface, the first tapered surface narrowing in width and ending in a first arcuate edge opposite the first straight edge;

a second tapered surface having a second straight edge corresponding to the distal edge of the second flat surface, the second tapered surface narrowing in width and ending in a second arcuate edge opposite the second straight edge;

a third tapered surface having a first curved edge disposed and connected between the first straight edge of the first tapered surface and the second straight edge of the second tapered surface, the third tapered surface narrowing in width and ending in a third arcuate edge opposite the first curved edge; and a fourth tapered surface having a second curved edge disposed and connected between the first straight edge of the first tapered surface and the second straight edge of the second tapered surface, the fourth tapered surface narrowing in width and ending in a fourth arcuate edge opposite the second curved edge.

20. The golf putter of claim 19, wherein the first, second, third, and fourth arcuate edges intersect to form an arcuate end at the distal end of the golf club grip.

* * * * *